US006293125B1

(12) United States Patent
Cole et al.

(10) Patent No.: US 6,293,125 B1
(45) Date of Patent: Sep. 25, 2001

(54) NON-DIRECTIONAL FILTER DRYER

(75) Inventors: Robert G. Cole, Greenfield, TN (US); Cary Haramoto, Newark, NY (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 09/483,402

(22) Filed: Jan. 14, 2000

Related U.S. Application Data

(60) Provisional application No. 60/118,267, filed on Feb. 2, 1999.

(51) Int. Cl.[7] ..... F25B 43/04; B01D 27/00

(52) U.S. Cl. ..... 62/475; 62/474; 62/85; 210/446

(58) Field of Search ..... 62/475, 292, 474, 62/85; 210/420, 446, DIG. 7

(56) References Cited

U.S. PATENT DOCUMENTS

| | | | | |
|---|---|---|---|---|
| 2,628,484 | | 2/1953 | Ayres et al. . | |
| 3,175,342 | | 3/1965 | Balogh . | |
| 3,178,022 | | 4/1965 | Balogh . | |
| 4,029,580 | | 6/1977 | Lange . | |
| 4,104,044 | * | 8/1978 | Lange | 62/474 X |
| 4,125,469 | * | 11/1978 | Henton et al. | 210/446 X |
| 4,255,940 | | 3/1981 | Grahl et al. . | |
| 4,318,809 | * | 3/1982 | Bethel | 210/446 X |
| 4,320,000 | * | 3/1982 | Lange et al. | 210/446 X |
| 4,745,772 | * | 5/1988 | Ferris | 62/292 |
| 4,811,571 | * | 3/1989 | Mayer | 62/474 |
| 4,954,252 | * | 9/1990 | Griffin et al. | 210/446 X |
| 5,440,898 | * | 8/1995 | Starr | 62/474 |

* cited by examiner

*Primary Examiner*—Henry Bennett
*Assistant Examiner*—Chen-Wen Jiang
(74) *Attorney, Agent, or Firm*—Christopher H. Hunter

(57) ABSTRACT

A filter dryer for an air-conditioning system, including an elongated housing enclosing loose molecular sieve material, first and second fluid ports into the housing, a filter basket assembly supported at one end of the housing and a screen and baffle assembly supported at the opposite end of the housing. The first filter basket assembly includes a first cup-shaped filter basket which opens away from the first port toward the molecular sieve material. The first filter basket is retained by an annular, U-shaped flange to the inner surface of the housing by press-fit. The screen and baffle assembly includes a second cup-shaped filter basket which also opens away from the first port. The second filter basket includes a radially-enlarged cylindrical screen portion toward the open end of the basket, a radially-reduced cylindrical screen portion toward the closed end of the screen, and an annular shoulder between the radially-enlarged and radially-reduced portions. The second filter basket is also retained by an annular flange to the inner surface of the housing by press-fit. A perforated baffle plate is located against the molecular sieve material and a spring extends between the annular shoulder on the second filter basket and the baffle plate to urge the baffle plate against the molecular sieve material.

12 Claims, 2 Drawing Sheets

NON-DIRECTIONAL FILTER DRYER

RELATED CASES

The present application claims priority to U.S. Provisional Application Ser. No. 60/118,267; filed Feb. 2, 1999.

FIELD OF THE INVENTION

This invention relates to filter dryers and more particularly to a non-directional filter dryer which is especially useful in a refrigeration system or any other type of air conditioning system.

BACKGROUND OF THE INVENTION

In a typical refrigeration system, refrigerant (in a vapor state) is compressed by a compressor unit driven by a motor. The compressed refrigerant, at high temperature and pressure, enters the condenser where heat is removed from the compressed refrigerant and the refrigerant changes to a liquid state. The refrigerant then travels through a filter dryer to an expansion device. The expansion device throttles the refrigerant as the refrigerant flows through an orifice, which causes the refrigerant to change phase from liquid to a saturated liquid/vapor mixture. The mixture then enters an evaporator, where heat is drawn from the environment to replace the latent heat of vaporization of the refrigerant, thus cooling the environmental air and causing the refrigerant to change to a vapor state. The low pressure refrigerant flow from the evaporator returns to the suction side of the compressor to begin the cycle anew.

To operate the system as a heat pump, a reversing valve can be provided and the flow is diverted such that the original evaporator becomes the condenser, the original condenser becomes the evaporator and the flow through the liquid line reverses. Heat is then drawn from a heat sink, and provided to the environment to heat the environmental air.

Filter dryers are well-known in this field and utilize a filter dryer medium and simple interconnections with the plumbing of the system to separate particles and remove water contaminants from the refrigerant in the system.

One particularly useful filter dryer is shown in Grahl, et al., U.S. Pat. No. 4,255,940, which is owned by the assignee of the present invention. In the Grahl dryer, loose molecular sieve material is enclosed within a tubular housing having an inlet port and an outlet port. The molecular sieve is retained at one end of the housing by a cup-shaped filter basket formed of a fine mesh screen. The basket is fixed in place near the outlet port of the housing by means of a double-folded marginal flange which engages the inner surface of the housing. The shape of the filter basket provides increased surface area for filtration as compared to, e.g., a flat filter screen. The molecular sieve is retained at the other end of the housing by a dual baffle assembly. The dual baffle assembly includes first and second perforated baffles, with the first baffle having a peripheral flange sized to fixedly engage the inner surface of the housing near the inlet port, and the second baffle being in direct contact with the molecular sieve material and having a peripheral flange sized to be in sliding relation with the housing. A compression spring is disposed between the first and second baffles to urge the second baffle against the molecular sieve material to maintain the molecular sieve material in a compacted state during use.

While the Grahl dryer has had success in the marketplace, it is intended primarily for unidirectional flow through the dryer, that is, flow from the inlet through the dual baffle arrangement, through the molecular sieve, and then through the screen basket to the outlet. The dryer is not intended to be connected within the refrigeration system for flow in the opposite direction, as the loose molecular sieve material can leak through and around the movable second baffle of the dual baffle arrangement, and then through the openings in the first baffle, and enter the downstream portion of the refrigeration system. It is therefore necessary to separately label the ports of the filter dryer for correct hook-up, and care must be taken during the plumbing of the system to confirm that the dryer is correctly oriented.

It can also be desirable in some applications to filter the refrigerant prior to the refrigerant entering the molecular sieve material. This can increase the useful life of the molecular sieve material.

Bi-directional filter dryers are also known, for example as shown in Griffin, U.S. Pat. No. 4,954,252, which is also owned by the assignee of the present invention. In the Griffin dryer, a valving structure includes a pair of identical check valve assemblies at either end of a molded desiccant core. Each check valve assembly includes reed-type flapper valves formed from a single sheet of material. The Griffin dryer is appropriate for many biflow applications, however, the dual check valve assemblies increase the material and assembly cost of the filter dryer, and the molded desiccant core is generally more expensive than loose molecular sieve material.

As such, while the known filter dryers may be appropriate for certain applications, applicants believe that there is a demand for a filter dryer for an air-conditioning system which uses loose molecular sieve material as a desiccant, and which can be connected in the system for refrigerant flow in either direction. It is therefore not necessary to separately label the ports of the filter dryer, or to have concern that the dryer could be connected in the wrong orientation. In addition, it is believed there is a continual demand for new and unique filter dryer which is economical, meets the performance and reliability demands in the industry, and which requires a minimum of components which are relatively easy and straight-forward to manufacture and assemble.

SUMMARY OF THE PRESENT INVENTION

A new and unique filter dryer is provided which uses loose molecular sieve material and which can be connected within an air-conditioning system for flow in either direction. The filter dryer has an economical, robust structure which is easy and straight-forward to manufacture and assemble to meet performance and reliability demands in the industry.

According to the present invention, the filter dryer includes a tubular housing having a first port at one of the housing, and a second port at the other end of the housing. Loose molecular sieve material is disposed within the housing, and supported at the one end by a first filter basket assembly including a first cup-shaped filter basket, with the open end of the filter basket opening toward the desiccant material, and away from the first port of the housing. The filter basket is retained within the housing by an annular flange or bracket which has a U-shape in cross-section to closely receive and support the open end of the basket, and which is retained by press-fit with the inside surface of the housing.

The molecular sieve material is supported at the other end of the housing by a screen and baffle assembly. The screen and baffle assembly includes a second filter basket assembly including a second cup-shaped filter basket also opening toward the second port in the housing and away from the desiccant material. The second filter basket includes a radially-enlarged cylindrical screen portion located toward the open end of the basket, a radially-reduced cylindrical screen portion located toward the closed end of the basket, and an annular shoulder interconnecting the radially-enlarged and radially-reduced portions. An annular flange or bracket with a U-shape in cross-section closely receives the open end of the filter basket and is press-fit with the inner surface of the housing. The screen and baffle assembly also includes a perforated baffle plate provided directly against the desiccant material, and a spring which extends between the baffle plate and the annular shoulder of the filter basket. The spring receives and surrounds the radially-reduced portion of the second filter basket and urges the baffle against the loose molecular sieve material to maintain the molecular sieve material in a compacted state during use.

If the filter dryer is installed within the air-conditioning system such that refrigerant enters the first port, the first cup-shaped filter basket will filter the refrigerant and allow the filtered refrigerant to pass through the molecular sieve material and then through the screen and baffle assembly to the second port. The molecular sieve fills and supports the first basket such that in the event the first filter basket becomes clogged with particulates, the increase in pressure against the screen will not damage the screen. The cup-shape configuration of the first filter basket increases the surface area available for filtration for refrigerant flow in this first direction. The first and second filter baskets preferably have the same filtration efficiency, so that the filtered refrigerant will then easily pass through the downstream second filter basket.

On the other hand, if the dryer is connected such that flow enters the opposite, second port, the flow passes initially through the second filter basket, where particulates are separated, and then through the molecular sieve to remove water contaminants, and finally through the first filter basket to the first port. The cup-shape configuration of the second filter basket also increases the surface available for filtration for flow in this direction. Thus, the refrigerant is effectively filtered in both directions prior to entering the molecular sieve material. Should the second filter basket become clogged with particulate matter, and the pressure increase, the downstream orientation of the second filter basket will prevent the basket from becoming damaged. Moreover, should the basket become disconnected from the annular flange fixing the basket to the sidewall of the dryer, the second filter basket will merely move downstream against the baffle plate, without allowing refrigerant and contaminant bypass of the basket.

The filter dryer of the present invention thereby separates particles entrained in the refrigerant and removes undesirable water contaminants for flow in either direction through the filter dryer.

The filter dryer of the present invention is also relatively straight-forward to manufacture and assemble. The first filter basket assembly is inserted through one of the ends of the tubular housing to a location adjacent the other end, with the open end of the first filter basket facing toward the first end of the housing. The annular flange of the first filter basket retains the filter basket within the housing by press-fit. The loose desiccant material is then loaded through the first end of the housing—filling the first filter basket and a substantial portion of the housing. The second filter basket assembly is then inserted through the first end of the housing, with the perforated baffle plate disposed directly against the molecular sieve material, the compression spring disposed between the baffle and second filter basket assembly, and the open end of the second filter basket facing toward the first end of the housing. The annular flange of the second filter basket also retains the second basket within the housing by press-fit. The ends of the housing are then formed to define first and second necked-down ports.

As described above, the filter dryer of the present invention uses loose molecular sieve material and can be connected to receive refrigerant flowing in either direction. The filter dryer is relatively easy and straight-forward to manufacture and assemble, which reduces the over-all cost of the filter dryer.

Further features of the present invention will become apparent to those skilled in the art upon reviewing the following specification and attached drawings

DETAILED DESCRIPTION OF THE PREFERRED EMBODIMENT

Figure 1:
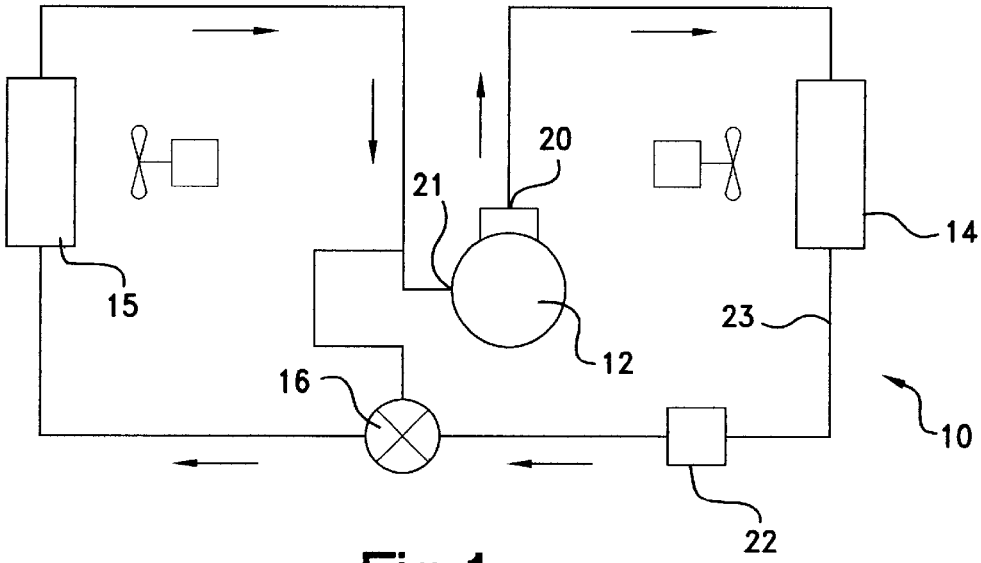
FIG. 1 is a schematic drawing of a refrigeration system showing the filter dryer of the present invention located at the discharge line of a compressor.

Referring to the drawings and initially to FIG. 1, a refrigeration system is indicated generally at 10, and includes a compressor 12, a condenser 14, an evaporator 15 and an expansion device 16. The compressor 12, condenser 14, evaporator 15 and expansion device 16 are preferably components which are commercially-available from a wide-variety of sources. The internal operation of these components are well-known and will not be discussed herein for sake of brevity. The function of the air-conditioning system should also be well-known, and will not be discussed in detail. While the system is shown and will be primarily described as operating as a refrigeration system (i.e., in a cooling mode), it should also be appreciated that a reversing valve could be provided and the system could be operable as a heat pump system (i.e., in a heating mode). Additional discussion of such a reversible refrigeration/heat pump system can be found in U.S. Pat. No. 4,255,940, which to the extent necessary is incorporated herein by reference.

In any case, the compressor 12 has a discharge line outlet 20 connected to receive vaporous refrigerant at low pressure from evaporator 15, and a suction line inlet 21 connected to direct vaporous refrigerant at high pressure to condenser 14. The filter dryer 22 of the present invention is connected downstream from the discharge line outlet 20 of the compressor, and is preferably connected downstream from the condenser 14 in condenser liquid line 23, although it should be appreciated that the dryer could be connected at any location in the system. When the system operates in a cooling mode, refrigerant flows through the system in the direction of the arrows indicated in FIG. 1. Of course, when the system is connected in a heating mode the refrigerant flows in the reverse direction.

Figure 2:
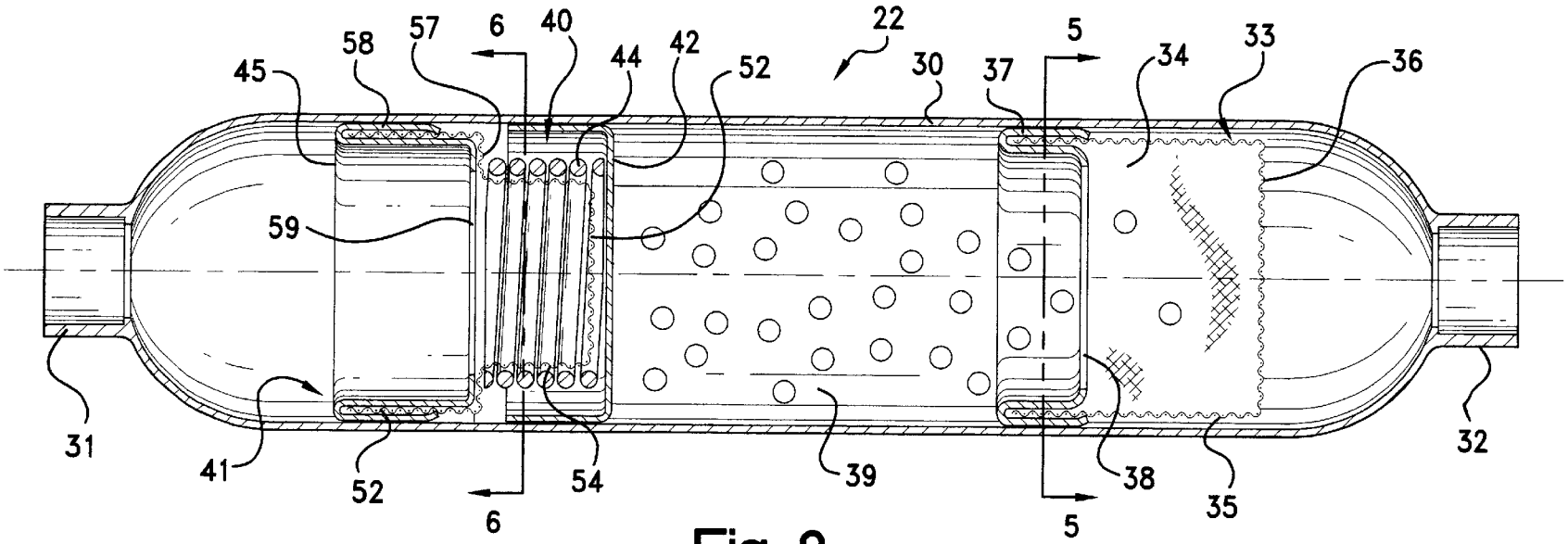
FIG. 2 is a cross-sectional view of a preferred embodiment of the filter dryer.

Referring now to FIG. 2, a preferred embodiment of the filter dryer 22 is shown which includes an elongated tubular housing 30 having a first necked-down port 31 at one end of the housing, and a similar, second necked-down port 32 at the other end of the housing. First and second outlet ports 31, 32 can be formed by any appropriate manufacturing technique, such as spin-forming or impacting. The housing is preferably constructed of copper and shown of a one-piece construction in the preferred embodiment of the invention, but it will be understood that other configurations may also be employed, such as a two-piece construction, and other material could also be used.

Figure 5:
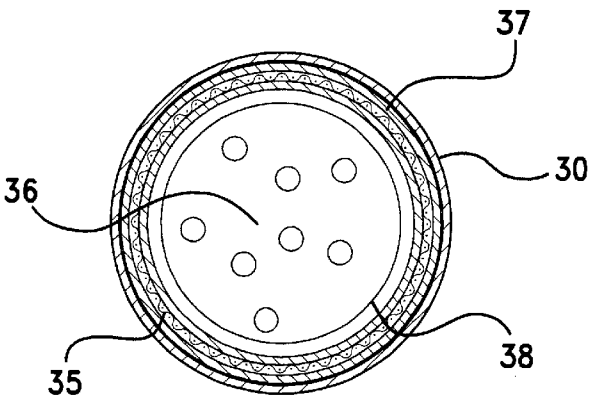
FIG. 5 is a cross-sectional end view of the filter dryer taken substantially along the plane described by the lines 5—5 in FIG. 2.

A first filter basket assembly, indicated generally at 33, is contained within the housing 30 toward second port 32. The first filter basket assembly includes a first cup-shaped filter basket 34 opening away from adjacent port 32 (toward port 31) and formed from a fine mesh screen. The filter basket 34 has a cylindrical side wall 35 and integral end wall 36. End wall 36 is either formed in one piece with side wall 35, or separately attached such as by welding. Filter basket 34 is retained in fixed relation to housing 30 by means of a first double-folded annular flange or bracket 37. The annular flange 37 defines a central opening 38 (see also FIG. 5), and has a U-shape in cross-section, with the opening of the "U" facing port 32 and closely receiving and inwardly and outwardly surrounding the open end of the filter basket 34. The sides of the "U" are crimped together to retain the basket to the flange. The annular flange 37 has a peripheral dimension such that the flange 37 fixedly engages the inner surface of the housing with preferably a press-fit to hold the flange and first filter basket to the housing.

A molecular sieve material 39 is contained within the housing 30 to capture water contaminants in the refrigerant. Molecular sieve material 39 is preferably a naturally occurring or synthetic crystalline aluminosilicate material belonging to the class of minerals known as zeolites, and having the characteristic of being able to undergo dehydration with little or no change in crystal structure. The dehydrated crystals are interlaced with regularly spaced channels of molecular dimensions and this network of uniform pores comprises almost 50% of the total volume of the crystals. A molecular sieve type 4A-XH6 manufactured by Union Carbide Corporation is suitable for the present invention, as it has a suitable water capacity at elevated temperatures that it can be applied to discharge line service which is on the order of 200°–250° F. and still retain adequate water capacity for system protection. The molecular sieve material 39 is received within the open end of filter basket 33 (through opening 38 in flange 37) to support the molecular sieve at the one end of the housing. The molecular sieve material is supported at the other end of the housing by means of screen and baffle assembly, indicated generally at 40. The screen and baffle assembly 40 includes a second filter basket assembly, indicated generally at 41, a perforated circular baffle plate 42 disposed directly against the molecular sieve material 39, and a spring 44 extending between the filter basket 45 and the perforated baffle plate 42.

Figure 4:
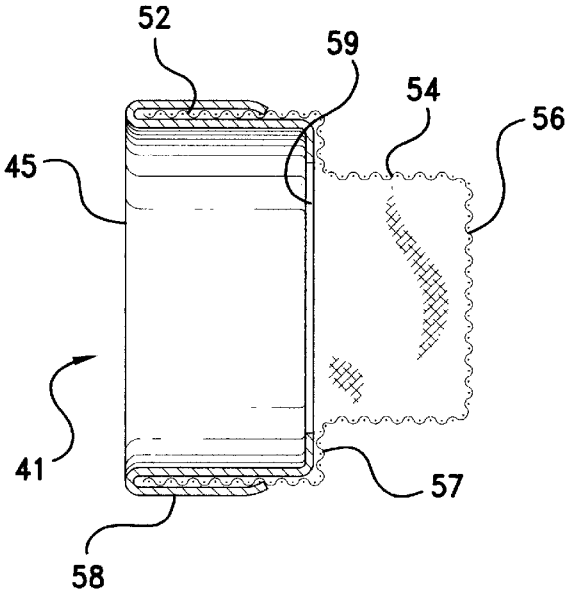
FIG. 4 is a cross-sectional side view of the filter basket for the screen and baffle assembly.

The second filter basket assembly 41 includes a second cup-shaped filter basket 45 disposed adjacent port 31 and opening away from port 32 (toward port 31). The second cup-shaped filter basket 45 is formed of the same mesh screen (with the same pore size) as the first filter basket 33, such that the first and second filter baskets have the same filtration efficiency. As shown in FIGS. 2 and 4, the second filter basket 45 includes a radially-enlarged cylindrical screen portion 52 adjacent the open end of the basket, a radially-reduced cylindrical portion 54 adjacent the closed end of the basket with an integral end wall 56, and an integral annular shoulder 57, interconnecting the radially-enlarged portion 52 and the radially-reduced portion 54 of the filter basket. The radially-enlarged and radially-reduced cylindrical screen portions 52, 54, end wall 56 and shoulder 57 can either formed in one piece, or formed separately and attached together such as by welding.

The second filter basket 45 is retained in fixed-relation to housing 30 by means of a second double-folded annular flange or bracket 58. The annular flange 58 defines a central opening 59 (see also FIG. 6), and has a U-shape in cross-section, with the opening of the "U" facing port 32 and closely receiving and inwardly and outwardly surrounding the radially-enlarged cylindrical screen portion 52 of the filter basket. The inner wall portion of the U-shaped flange abuts against the annular shoulder 57 of the filter basket, and to some extent provides definition and support for the shoulder. The sides of the "U" are crimped together to retain the basket to the flange. The annular flange 58 has a peripheral dimension such that the flange fixedly engages the inner surface of the housing with preferably a press-fit to hold the flange and the second filter basket to the housing.

Figure 3:
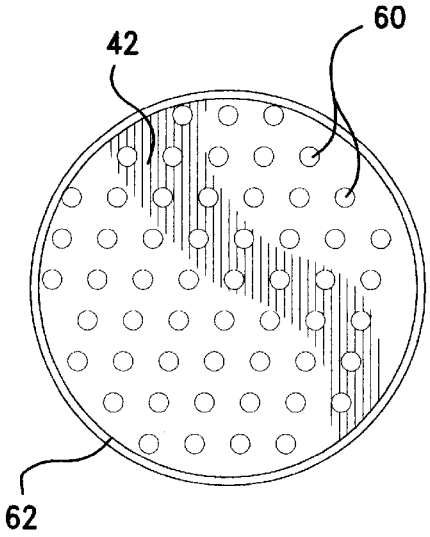
FIG. 3 is a left-end view of the baffle plate for the screen and baffle assembly.

As shown in FIG. 3, the baffle plate 42 of the assembly includes a series of perforations 60 disposed uniformity across the plate, and having a dimension slightly smaller than the molecular sieve material to prevent the material from passing through the perforations. The plate is bounded by an annular flange 62, having an outer dimension slightly smaller than the inner dimension of the housing, such that the baffle plate can slide within the housing.

Figure 6:
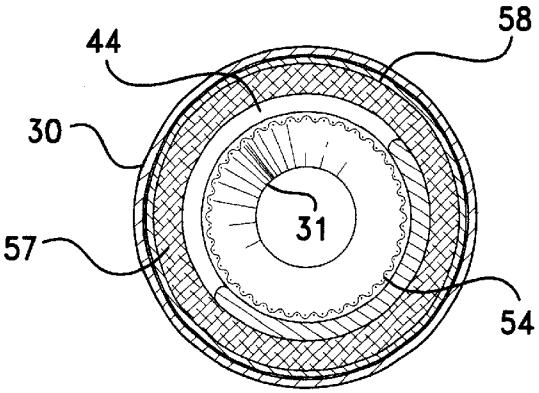
FIG. 6 is a cross-sectional end view of the filter dryer taken substantially along the plane described by the lines 6—6 in FIG. 2.

Spring 44 is preferably a metal compression spring and is disposed between and against baffle plate 42 and the annular shoulder 57 of the second filter basket 45. The spring biases the baffle plate 42 against the molecular sieve material 39. As can be seen in FIGS. 2 and 6, spring 44 receives and surrounds the radially reduced cylindrical portion 54 of the second filter basket. While not shown, an annular ceramic gasket can be provided between the end of the spring and the annular shoulder 57 of the basket to prevent damage to the screen of the filter basket, if desirable. In a normal assembled state of the dryer, a small gap is provided between the end 56 of the filter basket and baffle plate 42.

The filter dryer 22 described above is relatively easy to assemble. A tubular housing having open ends is first provided. The filter basket assembly 33 is inserted through one of the opens end of the housing (e.g., the end which will become port 31), and located adjacent the other end (e.g., the end which will become port 32), with the open end of the filter basket 34 facing toward the first end (away from the second end), and the flange 37 being press-fit with the housing. The molecular sieve material 38 is then loaded (poured) through the first end of the housing, to fill the first filter basket as well as a substantial portion of the housing.

The screen and baffle assembly 40 is then inserted through the first end of the housing, with the baffle plate 42 located directly against the molecular sieve material, and in a generally perpendicular orientation with respect to the axis of the housing. Since baffle plate 42 has a slightly smaller peripheral dimension than housing 30, the baffle plate 42 can slide axially relative to housing 30. Spring 44 and second filter basket assembly 41 are then inserted through the first end of the housing, with the open end of the second filter basket 45 also facing toward the first end (away from the second end), and the flange 58 being press-fit with the housing. When properly assembled, the spring 44 biases the baffle plate 42 against the molecular sieve material to hold the material in a secure, compacted state, with the molecular sieve material completely filling the available space between the first filter basket 33 and baffle plate 42.

The first port 31 is then formed (e.g., spin-formed or impacted) at the first end of the housing, and the second port 32 is formed (e.g., spin-formed or impacted) at the other end of the housing. It is noted that assembling the components of the dryer from one end of the housing generally facilitates the assembly process and helps to minimize the assembly costs. This one-end assembly is facilitated by the same-direction orientation of both filter basket assemblies.

The filter dryer 22 is then connected downstream from the condenser 14, in the liquid line 23 (FIG. 1) of the condensor 14, or other appropriate location within the air-conditioning system. The liquid line can be connected to either port 31 or 32, with the same filtering and water removal effect. If the filter dryer is connected such that refrigerant flows through port 32, particulate matter is first separated by the first filter basket 34, and the filtered fluid then passes through the molecular sieve material 39, through baffle plate 42, and then through the second filter basket 45 to the opposite port 31. Should the particulate matter clog the first filter basket, and the pressure increase upstream from the dryer, the desiccant material 39 generally supports the first filter basket internally such that the basket is not damaged.

On the other hand, should inlet flow be through port 31, the particulates will be initially separated by the second filter basket 45, and the filtered fluid will then flow through baffle plate 42, the molecular sieve material 39, and the first filter basket 34 to the opposite port 32. In this orientation, should the second filter basket become clogged with particulate matter, and the fluid pressure increases upstream of the dryer, the downstream orientation of the second filter basket will prevent the basket from being damaged. Moreover, should the second filter basket become disconnected from the housing, such as the filter basket becoming unattached from flange 52, the second filter basket will merely pass a short distance downstream until the end 56 of the filter basket contacts baffle plate 42 (with the open end of the filter basket still within the "U" of the flange 52), at which point baffle plate 42 will support the end of the second filter basket, and the spring 44 will support the sides of the radially-reduced cylindrical screen portion of the second filter basket. The second filter basket will remain intact and oriented in substantially the same manner, so as to prevent refrigerant and contaminant bypass of the second filter basket.

In either connection, spring 44 is generally strong enough to urge baffle plate 42 against the molecular sieve material to maintain the material in a compacted state during operation.

As such, as described above, a novel and unique filter dryer for removing water contaminants from an air-conditioning system is provided. The filter dryer uses loose desiccant material and can be connected for refrigerant flow in either direction. The filter dryer is relatively easy and straight forward to manufacture and assemble, which reduces the over-all cost of the filter dryer.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An air-conditioning system, comprising a compressor having a discharge outlet for delivery of pressurized vaporous refrigerant to the system, a condenser for cooling the pressurized refrigerant to a liquid state, an expansion device and an evaporator for converting the liquid refrigerant back to a vaporous state for return to the compressor, and a dryer connected downstream from the condenser, said dryer having a tubular housing enclosing molecular sieve material, and first and second fluid ports at opposite ends of the housing, said molecular sieve material being supported by a first filter basket assembly at one end of the housing, and a screen and baffle assembly at the other end of the housing, said first filter basket assembly including a first cup-shaped filter basket, located adjacent the second port and opening away from the second port toward the molecular sieve material, and an annular flange supporting the open end of the first filter basket, and fixing the open end of the first filter basket to an inside surface of the housing, said screen and baffle assembly including a second filter basket assembly including a second cup-shaped filter basket, said second filter basket located adjacent the first port and opening toward the first port and away from the molecular sieve material, and an annular flange supporting the open end of the second filter basket, and fixing the open end of the second filter basket to the inside surface of the housing, said second filter basket including a radially-enlarged cylindrical screen portion toward the open end of the second basket supported by the flange, and a radially-reduced cylindrical screen portion toward the closed end of the second basket, said screen and baffle assembly also including a perforated baffle plate disposed against the molecular sieve material toward the end of the housing with the second filter basket, and a spring extending between the baffle plate and the shoulder of the second filter basket, and receiving and surrounding the radially-reduced portion of the second filter basket, said spring biasing the baffle plate against the molecular sieve material to maintain the molecular sieve material in a compacted state.

2. The air-conditioning system as in claim 1, wherein said molecular sieve material is a loose desiccant material.

3. The air-conditioning system as in claim 1, wherein said annular flanges for the first and second filter basket assemblies each have a U-shaped configuration in cross-section, receiving and inwardly and outwardly surrounding the open ends of the respective filter baskets.

4. The air-conditioning system as in claim 1, wherein said annular flanges for the first and second filter basket assemblies retain the open end of the respective filter baskets by press-fit to an inside surface of the housing.

5. The air-conditioning system as in claim 1, wherein the first port of said housing is connected to receive refrigerant from the discharge outlet of the condenser, and said second filter basket can become unattached from the associated flange under certain high pressure situations when the second filter basket becomes clogged with particulates in the refrigerant, where the unattached second filter basket will then move downstream with the refrigerant flow and the closed end of the second filter basket will contact and be supported against further movement by the baffle plate and the radially-reduced cylindrical screen portion will be supported by the spring.

6. A filter-dryer for use in an air-conditioning system including a compressor, said filter-dryer comprising an elongated housing enclosing molecular sieve material, and first and second fluid ports at opposite ends of the housing, said molecular sieve material being supported by a first filter basket assembly at one end of the housing, and a screen and baffle assembly at the other end of the housing, said first filter basket assembly including a first cup-shaped filter basket, located adjacent the first port and opening away from the first port toward the molecular sieve material, and an annular flange supporting the open end of the basket and fixing the open end of the first filter basket to an inside surface of the housing, said screen and baffle assembly including a second filter basket assembly having a second cup-shaped filter basket, said second filter basket located adjacent the first port and opening toward the first port and away from the molecular sieve material, and an annular flange supporting the open end of the second basket, and fixing the open end of the second basket to the inside surface of the housing, said second filter basket including a radially-enlarged cylindrical portion toward the open end of the filter basket supported by the flange, and a radially-reduced cylindrical portion toward the closed end of the second end of the filter basket, and an annular shoulder between the radially-enlarged and radially-reduced portions of the basket, said screen and baffle assembly also including a perforated baffle plate disposed against the sieve material toward the end of the housing with the second filter basket, and a spring extending between the baffle plate and the shoulder of the second filter basket, and receiving and surrounding the radially-reduced portion of the second filter basket, said spring biasing the baffle plate against the molecular sieve material to maintain the molecular sieve material in a compacted state.

7. The filter-dryer as in claim 6, wherein said molecular sieve material is a loose desiccant material.

8. The filter-dryer as in claim 6, wherein said flanges for the first and second filter basket assemblies each have a U-shaped configuration in cross-section, receiving and inwardly and outwardly surrounding the open end of the respective filter baskets.

9. The filter-dryer as in claim 6, wherein said flanges for the first and second filter basket assemblies retain the open end of the respective filter baskets by press-fit to an inside surface of the housing.

10. The filter-dryer as in claim 6, wherein said second filter basket can become unattached from the associated flange under certain high pressure situations when the refrigerant is flowing first through the second filter basket and then through the molecular sieve material and the second filter basket becomes clogged with particulates, where the unattached second filter basket will move downstream with the fluid flow and a closed end of the second filter basket will contact and be supported against further movement by the baffle plate, and the radially-reduced cylindrical screen portion will be supported by the spring.

11. A method for assembling a filter-dryer, comprising the steps of:

i) providing a tubular housing having an open first end, and a second end;

ii) inserting a first filter basket assembly into the housing through the open first end, said first filter basket assembly including a first cup-shaped filter basket and an annular flange supporting the open end of the basket, said first filter basket being inserted through the first end such that the open end of the basket faces away from the second end and toward the first end, said flange retaining the first filter basket against the inside surface of the housing adjacent the second end;

iii) loading loose molecular sieve material into the housing through the open first end, such that the filter basket assembly supports the molecular sieve material at the second end of the housing;

iv) inserting a screen and baffle assembly into the housing through the open first end, said screen and baffle assembly including a circular baffle plate located against the molecular sieve material, a spring, and a second filter basket assembly, said second filter basket assembly having a second cup-shaped filter basket and an annular flange supporting the open end of the second filter basket, said second filter basket including a radially-enlarged cylindrical portion toward the open end of the basket supported by the flange, and a radially-reduced cylindrical portion toward the closed end of the basket, and an annular shoulder between the radially-enlarged and radially-reduced portions of the basket, said screen and baffle assembly being inserted through the open first end of the housing such that an open end of the second filter basket faces toward the open first end of the housing and away from the molecular sieve material and the reduced portion of the filter basket is received by and surrounded by the spring, said spring extending between the baffle plate and the shoulder of the second filter basket to bias the baffle plate against the molecular sieve material to maintain the molecular sieve material in a compacted state, said second flange retaining the second basket against the inner surface of the housing adjacent the open end; and v) forming the first end and the second end of the housing so as to provide necked-down first and second ports.

12. The method for assembling a filter-dryer as in claim 11, wherein the first and second flanges of the filter basket assemblies retain the respective filter baskets to the housing by press-fit.

* * * * *